US008312650B2

(12) United States Patent
McClanahan et al.

(10) Patent No.: US 8,312,650 B2
(45) Date of Patent: Nov. 20, 2012

(54) WEAR ASSEMBLY

(75) Inventors: Robert McClanahan, Milwaukie, OR (US); Terry L. Briscoe, Portland, OR (US)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 13/173,254

(22) Filed: Jun. 30, 2011

(65) Prior Publication Data

US 2012/0036743 A1 Feb. 16, 2012

Related U.S. Application Data

(62) Division of application No. 12/792,954, filed on Jun. 3, 2010, now Pat. No. 7,997,017, which is a division of application No. 11/633,996, filed on Dec. 4, 2006, now Pat. No. 7,730,652.

(60) Provisional application No. 60/752,283, filed on Dec. 21, 2005.

(51) Int. Cl.
*E02F 9/28* (2006.01)

(52) U.S. Cl. ..... 37/452

(58) Field of Classification Search ..... 37/452–460, 37/446, 448, 450; 403/379, 374, 316, 298, 403/374.1, 379.4
See application file for complete search history.

(56) References Cited

U.S. PATENT DOCUMENTS

| | | | | |
|---|---|---|---|---|
| 2,064,059 | A | 12/1936 | Fellmeth | |
| 2,603,009 | A | 7/1952 | Smith | |
| 2,772,492 | A | 12/1956 | Murtaugh | |
| 3,089,263 | A * | 5/1963 | Henkel | 37/456 |
| 3,388,488 | A | 6/1968 | Gerald | |
| 3,410,010 | A | 11/1968 | Ratkowski | |
| 3,453,755 | A | 7/1969 | Trudeau | |
| 4,233,761 | A | 11/1980 | Ryerson | |
| 4,433,496 | A | 2/1984 | Jones et al. | |
| 5,088,214 | A | 2/1992 | Jones | |
| 5,361,520 | A | 11/1994 | Robinson | |
| 5,653,048 | A | 8/1997 | Jones et al. | |
| 5,743,031 | A * | 4/1998 | Launder et al. | 37/455 |
| 5,964,547 | A | 10/1999 | Brinkley | |
| 6,018,896 | A | 2/2000 | Adamic | |
| 6,032,390 | A * | 3/2000 | Bierwith | 37/456 |
| 6,729,052 | B2 | 5/2004 | Ollinger, IV et al. | |
| 6,986,216 | B2 | 1/2006 | Emrich et al. | |
| 7,036,249 | B2 | 5/2006 | Mautino | |
| 7,080,470 | B2 | 7/2006 | Jones | |
| 7,165,347 | B2 | 1/2007 | Ollinger, IV et al. | |
| 7,171,771 | B2 | 2/2007 | Briscoe | |
| 7,174,661 | B2 | 2/2007 | Briscoe | |
| 7,523,572 | B2 * | 4/2009 | Pasqualini | 37/456 |
| 7,730,652 | B2 | 6/2010 | McClanahan et al. | |
| 2003/0037468 | A1 | 2/2003 | Adamic et al. | |
| 2004/0216334 | A1 | 11/2004 | Emrich et al. | |
| 2004/0216336 | A1 | 11/2004 | Briscoe | |
| 2004/0244236 | A1 | 12/2004 | Mautino | |
| 2005/0229442 | A1 | 10/2005 | Jones et al. | |
| 2006/0236567 | A1 | 10/2006 | Adamic | |

* cited by examiner

*Primary Examiner* — Robert Pezzuto
(74) *Attorney, Agent, or Firm* — Steven P. Schad

(57) ABSTRACT

In a wear assembly for securing wear members to excavating equipment, a spool is used with a wedge to hold the wear member in place. The spool is formed with at least one laterally extending arm at its upper end in lieu of an axial arm such as used in a conventional C-shaped spool. In this way, the spool can be easily supported in the assembly as the wedge is installed. The spool does not fall through the opening and no special care is needed to prevent it from falling. The spool also holds itself in place when the wedge is driven into the passage. As a result, installation of the wear assembly is easier and less hazardous. In addition, the lateral support reduces the risk that the spool will suffer spreading.

4 Claims, 14 Drawing Sheets

WEAR ASSEMBLY

This application is a divisional of application Ser. No. 12/792,954 filed Jun. 3, 2010, now U.S. Pat. No. 7,997,017, which is a divisional of patent application Ser. No. 11/633,996 filed Dec. 4, 2006, now U.S. Pat. No. 7,730,652, which is a non-provisional application based on provisional patent application Ser. No. 60/752,283, filed Dec. 21, 2005.

FIELD OF THE INVENTION

The present invention pertains to a wear assembly for securing a wear member to an excavating bucket or the like.

BACKGROUND OF THE INVENTION

Wear members in the form of adapters, shrouds, and the like are ordinarily secured to the front edge of an excavating bucket. Such wear members are commonly subjected to harsh conditions and heavy loading. Accordingly, the wear members wear out over a period of time and need to be replaced. The wear members are made to withstand the rigors of a digging operation and still be capable of replacement when worn. Whisler-style locking arrangements have long been in use for mechanically attaching wear members to the lip of a bucket. Such locks generally consist of a wedge and a C-shaped clamp or spool. While the wedge is typically hammered into the assembly, U.S. Pat. Nos. 4,433,496 and 5,964,547 disclose arrangements wherein the wedge is drawn into place under pressure from a screw. U.S. Patent Application Publication No. 2004/0216336 discloses a lock where the wedge is a conical threaded member that is turned to drive the wedge into and out of the assembly.

FIG. 19 discloses one example of a conventional Whisler shroud 21 attached to a lip 16. As seen in the drawing, the lip includes a digging edge 25, an inner surface 27 and an outer surface 29. A hole 31, which is elongated axially, extends through the lip at a location rearward of the digging edge. Hole 31 has a generally straight front wall 33 and a rear wall 35 that includes a step 37. The step includes a tapered surface 39 that tapers away from inner surface 27 as it extends rearward away from digging edge 25.

Shroud 21 wraps around the front end 25 of lip 16 with an inner leg 41 extending along inner surface 27 and an outer leg 43 extending along outer surface 29. Inner leg 41 includes an through-hole 47 which generally aligns with hole 31 when the shroud 21 is put on the lip. The hole 31 and opening 47 collectively define a passage 49 into which is received a lock 51 adapted to releasably hold the shroud 21 to the lip 16. Through-hole 47 includes a step 53 adjacent wear surface 55 of inner leg 41. As with step 37 in hole 31, step 53 includes a tapered surface 57 that tapers away from inner surface 27 as it extends rearward away from the digging edge 25. In this way, tapered surfaces 39, 57 diverge rearwardly at generally equal inclinations relative to a central axis of the lip 16.

Lock 51 includes a wedge 61 and a clamp or spool 63. Spool 63 has a C-shaped configuration with a generally vertical body 65 and two axially extending arms 67, 69. Upper arm 67 is adapted to fit within step 53, while lower arm 69 is adapted to fit within step 37. Each arm 67, 69 is formed with an inclined inner wall 71, 73 that conforms and sets against a respective tapered surface 39, 57. The front surface of body 65 defines a ramp surface 75 that is inclined forward (relative to vertical) as it extends downward in passage 49. Wedge 61 has front and rear converging walls 81, 83. Converging wall 83 abuts ramp surface 75 during installation and use in order to produce a tight fit of lock 51 in passage 49. As shown in FIG. 19, converging wall 83 and ramp surface 75 are formed with interlocking ridges 85 to ensure a stable and sure contact between the surfaces.

For installation, shroud 21 is first fit on lip 16 so that through-hole 47 generally aligns with hole 31. Spool 63 is then placed within the defined passage 49 with arms 67, 69 inserted into steps 37, 53. On account of the incline of tapered wall 57 and inner wall 71, the spool tends to slide forward and downward through passage 49 if not held in place. As a result, the spool at times can slip through the lip and fall to the ground requiring the worker to retrieve it from under the bucket. This can be a difficult process particularly if installation is being done at night. In addition, crawling under the bucket can place the worker in a potentially hazardous position.

The spool 63 must therefore be held in place while the wedge 61 is inserted into the assembly. In order to withstand the rigors of the digging operation, the wedge must be fit very tightly into passage 49. A large hammer is required to install the wedge into the assembly, which places the worker in a potentially hazardous position for injury from pieces that may fly off during hammering.

As wedge 61 is forced into passage 49, arms 67, 69 are pushed rearward over tapered walls 39, 57. This causes shroud 21 to be pulled tight against digging edge 25 and inner leg 41 to be pinched against lip 16. This tight fit is intended to resist heavy and diverse loading that may be applied to the wear member. The large forces applied to the spool arms can result in spreading of the arms. Such spreading reduces the grip of the lock on the wear member and can at times lead to failure of the lock.

SUMMARY OF THE INVENTION

The present invention pertains to an improved wear assembly for securing wear members to excavating equipment or the like.

The present invention regards a lock assembly for securing a wear member to a base. For example, the inventive lock is useful in securing a shroud or other wear member to a lip of an excavating bucket to avoid problems experienced in the prior art.

In one aspect of the invention, an improved spool is used with a wedge to hold the wear member in place. The spool is formed with at least one laterally extending arm at its upper end in lieu of an axial arm such as used in a conventional C-shaped spool. In this way, the spool can be easily supported in the assembly as the wedge is installed. The spool does not fall through the opening and no special care is needed to prevent it from falling. As a result, installation of the wear assembly is easier and less hazardous. In addition, the lateral support reduces the risk that the spool will suffer spreading.

In a preferred construction, an upper lateral arm extends outward from each side of a spool body to generally define a T-shaped configuration. The spool with upper lateral arms can be used with a variety of lower arms, such as an axial arm, lower lateral arms or other supports adapted to engage a lower leg or lower portion of the lip. In any of the combinations, the inner walls of the upper and lower arms are preferably inclined outward in a rearward direction to apply the rearward pinching force generally provided in Whisler-style locks.

Similarly, in another aspect of the invention, the wear member is formed with an opening having at least one spool support for receiving and holding a spool with a lateral arm. Preferably, the wear member is formed with a side recess as the spool support to each side of the lock-receiving opening.

As noted above, this new construction enables the wear member to be assembled on the lip or other equipment more easily and with less risk to the user.

DETAILED DESCRIPTION OF THE PREFERRED EMBODIMENTS

The present invention pertains to a wear assembly 100 in which a wear member 102 is releasably attached to excavating equipment 103 (FIGS. 1-4). In this application, wear member 102 is described in terms of a shroud that is attached to a lip of an excavating bucket. However, wear member 102 could be in the form of other kinds of products (e.g., adapters, wings, etc.) attached to other equipment. Moreover, relative terms such as forward, rearward, up or down are used for convenience of explanation with reference to the drawings; other orientations are possible.

Figure 1:
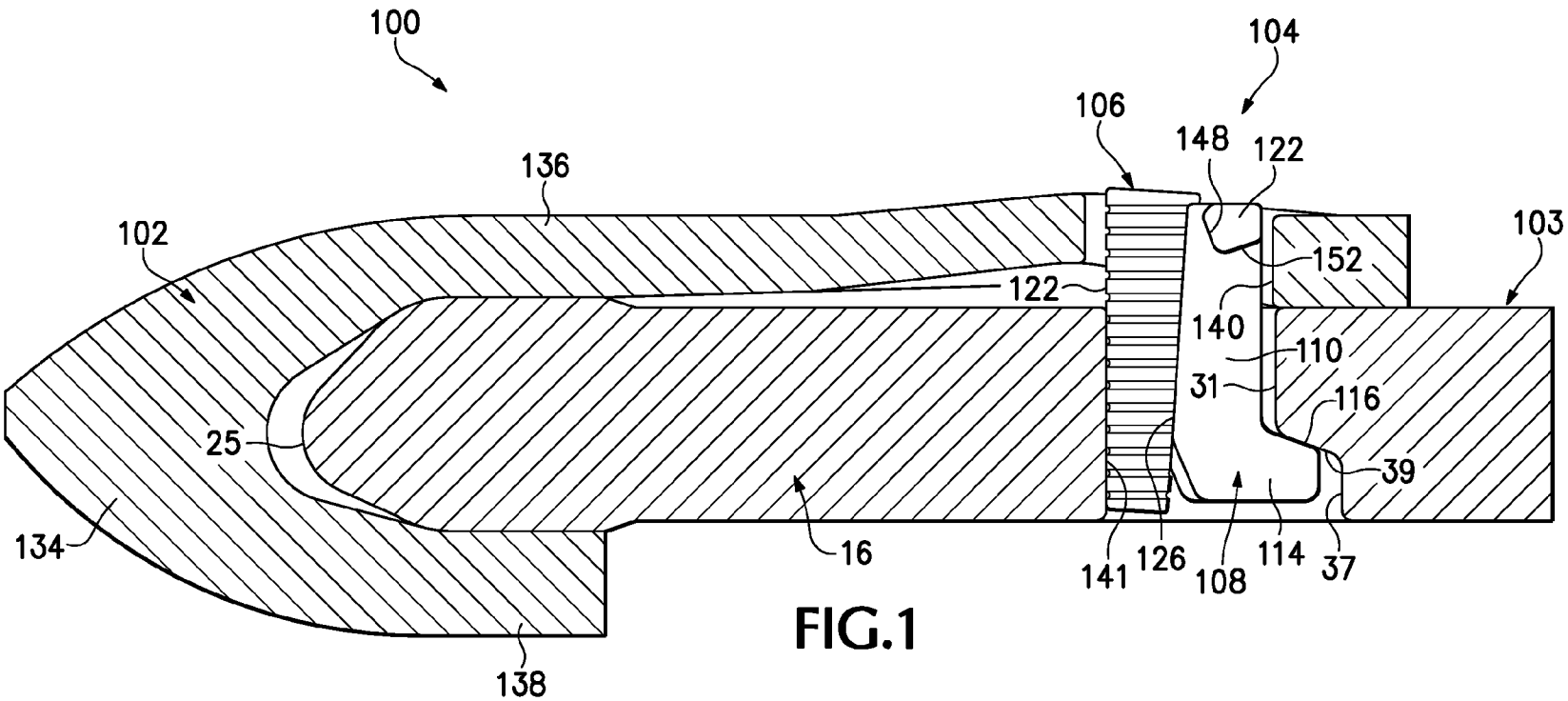
FIG. 1 is an axial cross-sectional view of a wear assembly in accordance with the present invention secured to a lip of a bucket.
Figure 2:
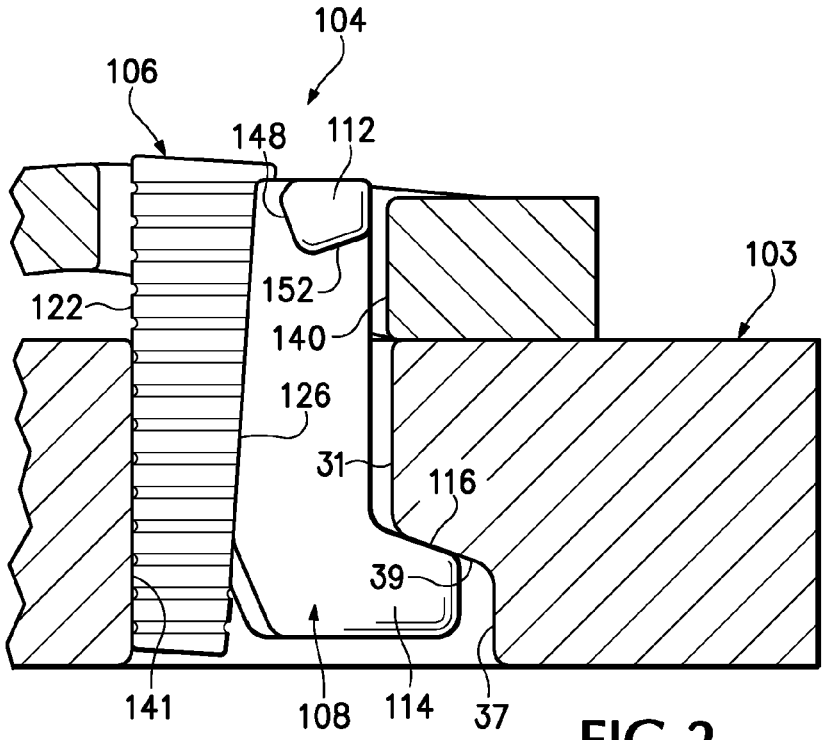
FIG. 2 is an enlarged, partial cross-sectional view of the wear assembly.
Figure 3:
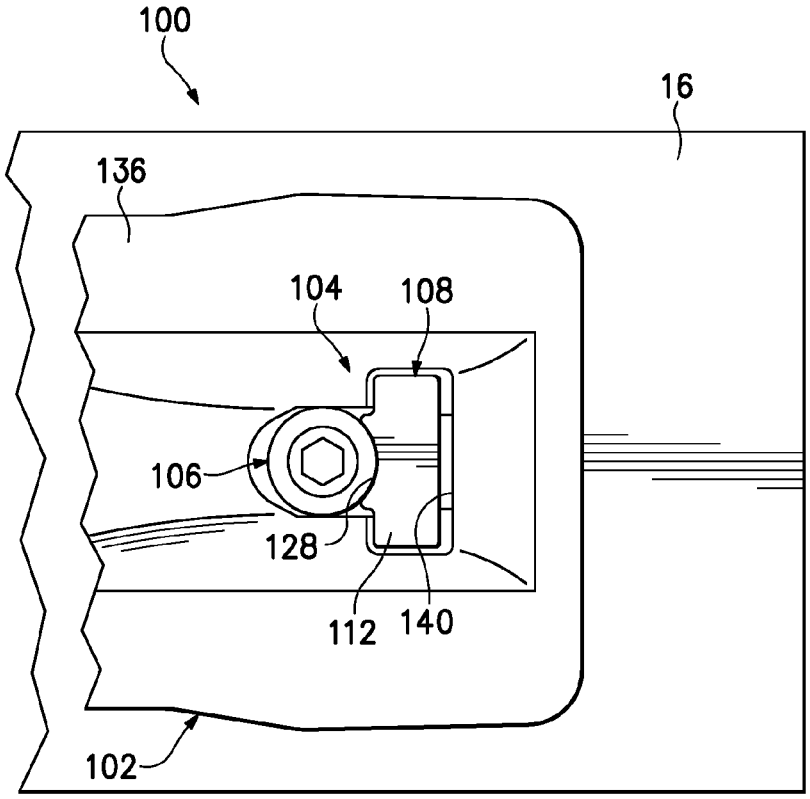
FIG. 3 is a partial top view of the wear assembly.
Figure 4:
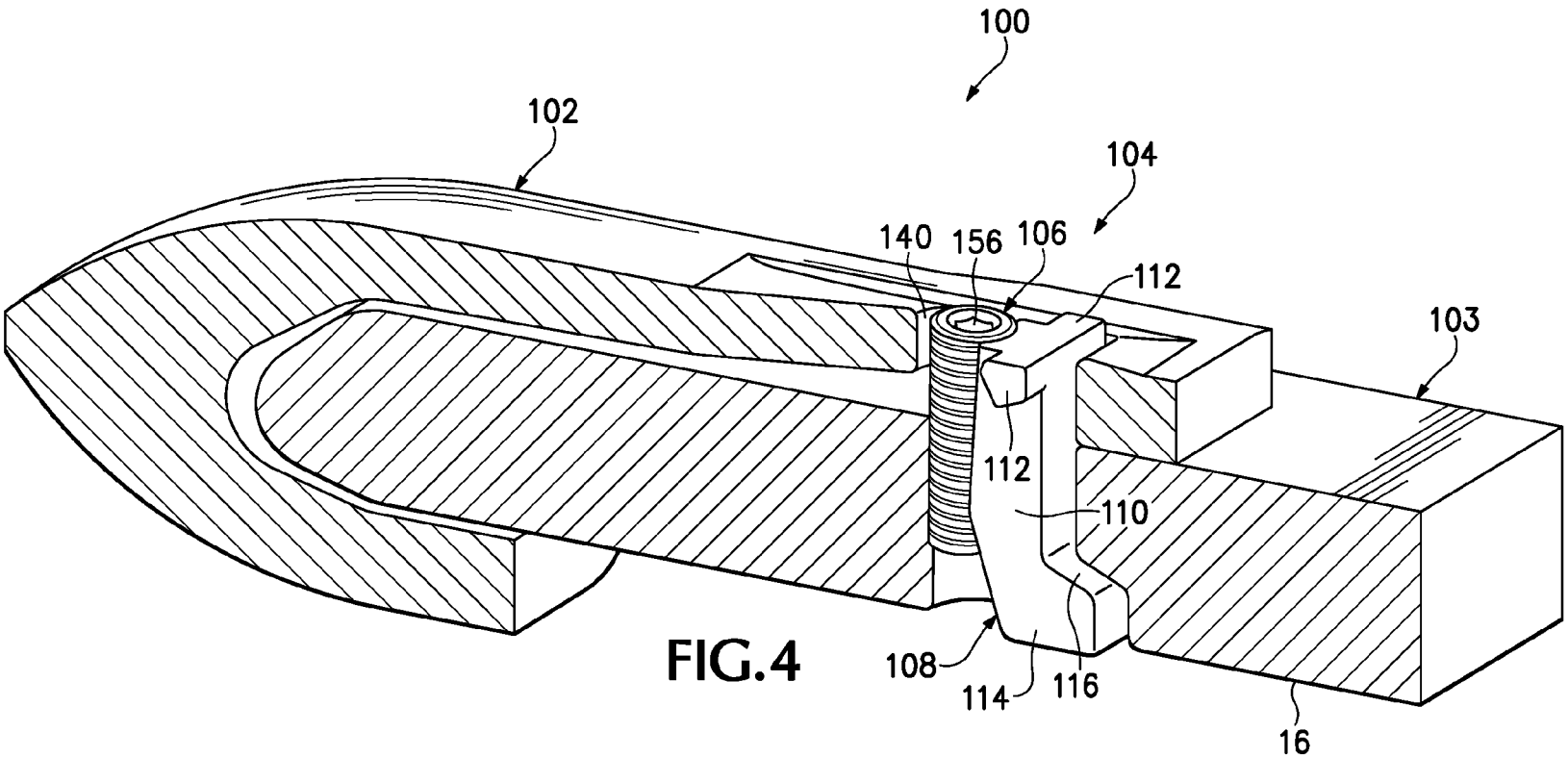
FIG. 4 is a perspective view of the wear assembly with an axial cross-section.
Figure 5:
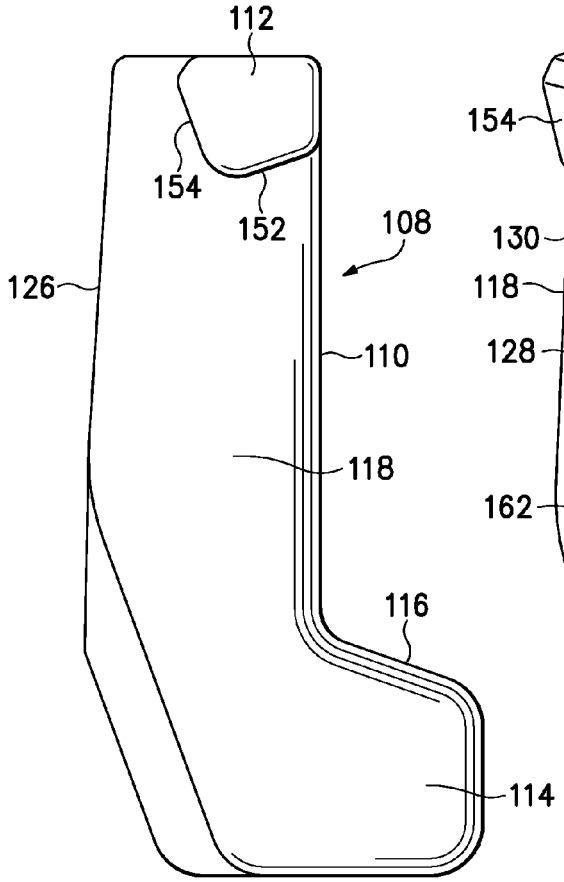
FIG. 5 is a side view of a spool in accordance with the present invention.

In one embodiment (FIGS. 1-4), shroud 102 fits on a conventional lip 16. Although the lip in FIG. 1 is slightly different than in FIG. 19, for convenience, the same numbers are used to identify the lip and its features. The particular lip construction is not critical for the invention, and an assembly in accordance with the present invention can be used with a wide range of lips.

Lock 104 includes a wedge 106 and a spool or clamp 108 to releasably secure shroud 102 to lip 16 (FIGS. 1-9). Spool 108 includes a body 110, at least one and preferably two upper arms 112, and a lower arm 114. Lower arm 114 is formed in the same manner as lower arm 69 in a conventional spool; i.e., lower arm 114 extends axially rearward from body 110. Lower arm 114 also has an inclined inner surface 116 that sets against tapered wall 39 formed in the lip. However, unlike a conventional spool, spool 108 includes at least one laterally extending upper arm 112 to engage shroud 102. In the preferred construction, an upper lateral arm 112 extends outward from each side 118 of body 110 in a transverse direction so as to define a generally T-shaped configuration with body 110.

In the preferred construction, wedge 106 has a rounded, conical shape with a helical thread 120 formed on its exterior surface 122, preferably in the form of a helical groove. The wedge is formed generally in accordance with the wedge disclosed in co-pending U.S. Patent Application Publication No. 2004/0216336 and U.S. patent application Ser. No. 10/824,490, which are both incorporated herein by reference. Spool 108 includes a front ramp surface 126, inclined to vertical, to abut exterior surface 122 of wedge 106. Ramp surface 126 preferably includes a trough 128 with a concave surface that generally conforms to the curve of wedge 106, but other concave configurations could be used to provide the desired support to the wedge. Other shaped ramp surfaces may also be used so long as the abutment of the wedge and spool is sufficient and stable in the assembly during use. The trough may extend substantially along the entire length of body 110 or only part way. In either case, a thread formation 130 is provided on ramp surface 126, and in this embodiment, within trough 128, to mate with thread 120 of wedge 106. Thread formation 130 may extend the entire length of trough 128 as shown or along only a part of the length.

Figures 10, 11:
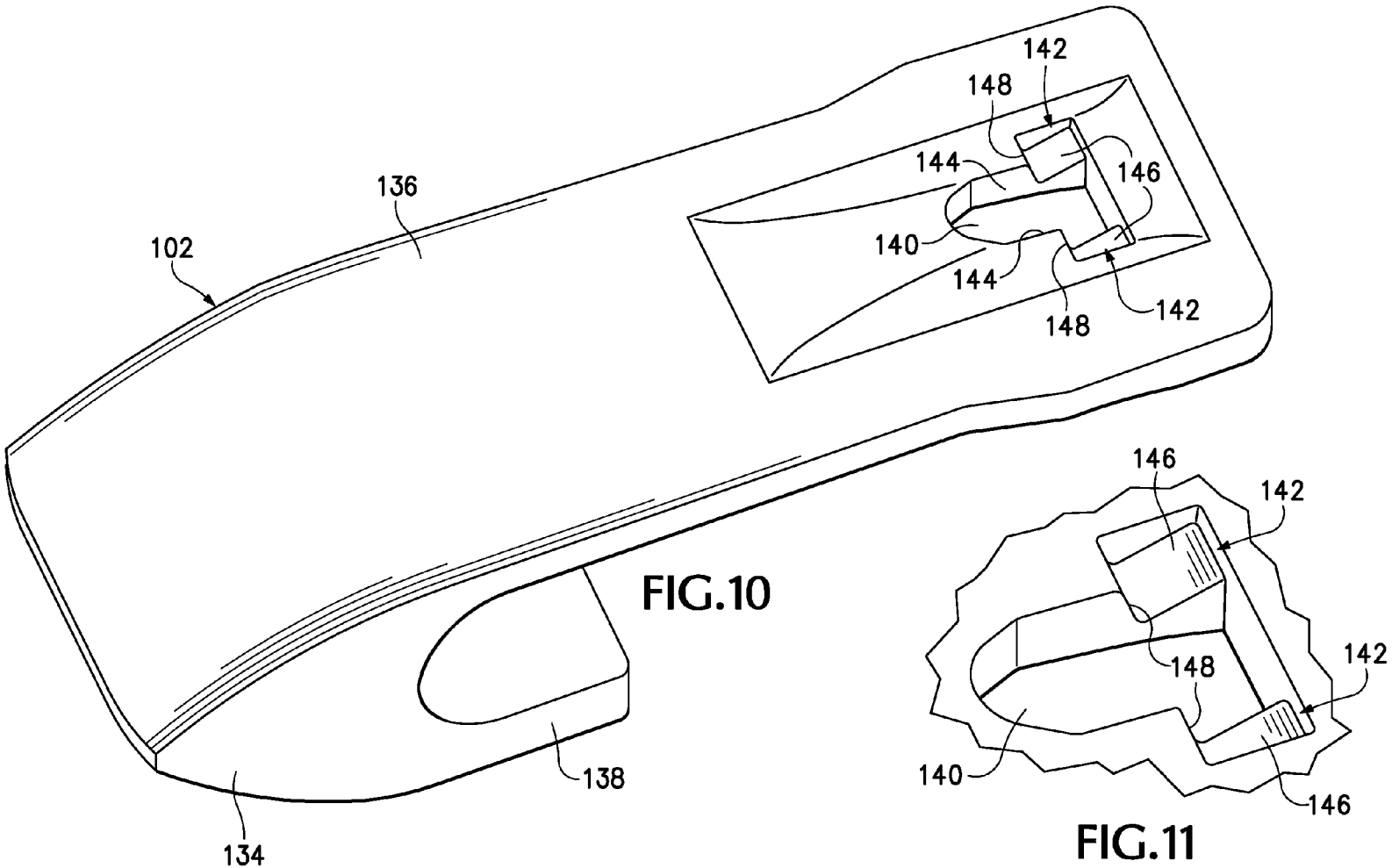
FIG. 10 is a perspective view of a wear member in accordance with the present invention.
FIG. 11 is an enlarged, partial perspective view of the through-hole in the wear member.
Figure 18:
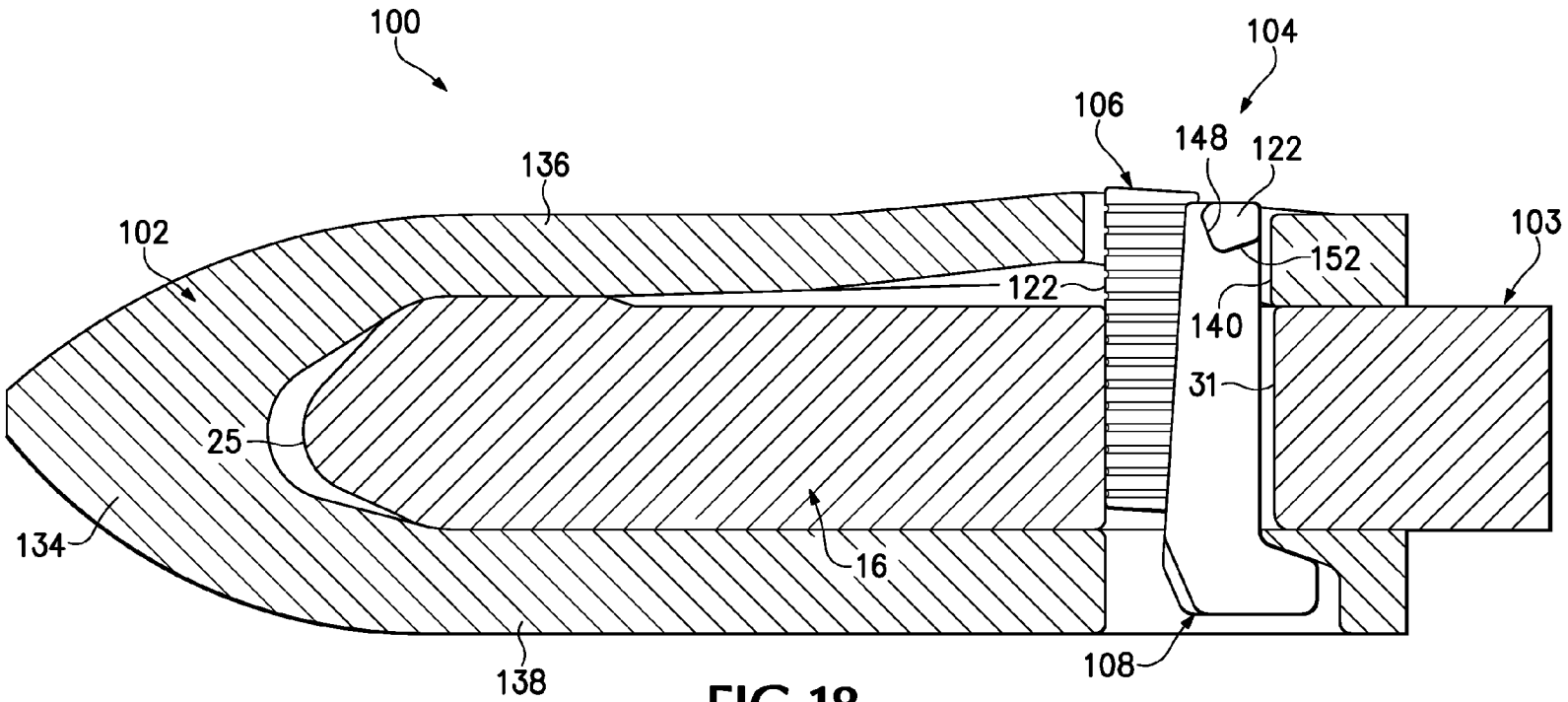
FIG. 18 is an axial cross-sectional view of a second alternative wear assembly in accordance with the present invention.

Wear member 102 is formed with a front working end 134, an inner leg 136 and an outer leg 138 (FIGS. 1-4 and 10-11). As with known shrouds, inner leg 136 is preferably longer than outer leg 138, but other arrangements could be used (see, e.g., FIG. 18 where the legs are the same length). Inner leg 136 includes a through-hole 140 that generally aligns with hole 31 in lip 16 to collectively define a passage 141. However, unlike conventional shrouds 21, through-hole 140 includes at least one and preferably two spool supports 142 extending along sides 144 (FIGS. 10 and 11). In a preferred construction, spool supports 142 are recesses or steps that extend partially through inner leg 136 within through-hole 140. In the preferred construction, each spool support or recess 142 includes a bearing surface 146 and a stop 148 in a generally V-shaped configuration, though other shapes could be used. Bearing surface 146 is preferably inclined away from lip 16 as it extends rearward away from digging edge 25 but other configurations could be used. The inclination of bearing surface 146 relative to the lip is preferably the same as tapered or inclined wall 39 in lip 16, albeit in the opposite direction. Stop 148 is preferably inclined away from the lip in the forward direction. As one example, bearing surface 146 sets about 18 degrees relative to lip 16, and about 90 degrees relative to stop 148; although a wide variation of each angle could be used.

Each lateral arm 112 of spool 108 is received into a corresponding spool support or recess 142 of shroud 102 (FIGS. 1-4). In the preferred construction, each upper arm 112 includes a bearing surface 152 and a stop 154 to complement and engage bearing surface 146 and stop 148 of the recess 142 into which it is received (FIGS. 3, 4, 10 and 11). Bearing surface 152 is inclined to generally conform to the inclination of bearing surface 146 in shroud 102, and stop 154 to generally conform to the inclination of stop 148, although other shapes are possible. When spool 108 is installed into passage 141, bearing surface 152 of spool 108 sets against bearing surface 146 of shroud 102, and stop 154 against stop 148. The engagement of surfaces 146, 152 and 148, 154 prevent the spool from falling through the passage 141. The V-shaped configuration of bearing surfaces 146, 152 and stops 148, 154 also hold spool 108 in place as wedge 106 is inserted.

To install lock 104, spool 108 is first placed into passage 141 such that lower arm 114 is set in step 37 and upper arms 112 are set in spool supports or recesses 142. The recesses 142 hold the spool in its proper position for receiving the wedge without any additional holding by a worker or anything else. As a result, the spool no longer falls through the lip to the ground. Additionally, workers are not forced into hazardous conditions when installing the locks.

Following insertion of spool 108, wedge 106 is installed into passage 141 between front wall 33 of hole 31 and ramp surface 126 of spool 108. In the preferred construction, wedge 106 includes a tool engaging structure 156 such as a socket for a wrench. Thread formation 120 of wedge 106 is engaged with thread formation 130 of spool 108, and the wedge rotated about its axis 158 to draw the wedge into passage 141. As the wedge is driven into the opening, spool 108 is pushed rearward such that bearing surfaces 152 press against bearing surfaces 146, and inner surface 116 presses against tapered wall 39. The upper and lower arms 112, 114 of spool 108, then, function to push shroud 102 rearward into a tight fit with lip 16 and to pinch inner leg 136 against the inner surface 27 of lip 16 for a secure attachment of the wear member to the bucket. The positioning of the upper arms 112 closer to the vertical axis of the spool also reduces the tendency for the upper and lower arms to spread apart during use; that is, this new orientation of the upper arms reduces the couple tending to spread the arms in conventional spools such that upper and lower arms 112, 114 of spool 108 experience less deformation in use.

Figure 6:
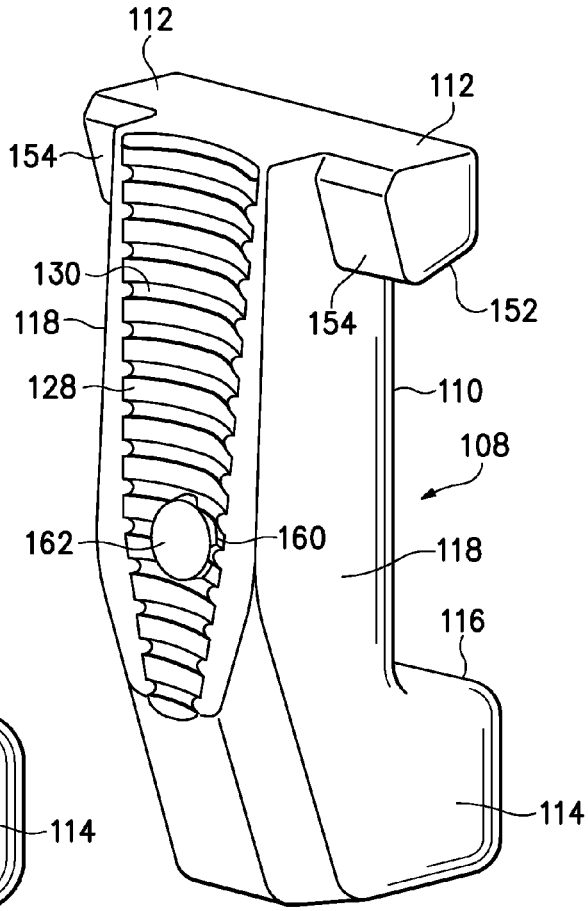
FIG. 6 is a front perspective view of the spool.
Figure 9:
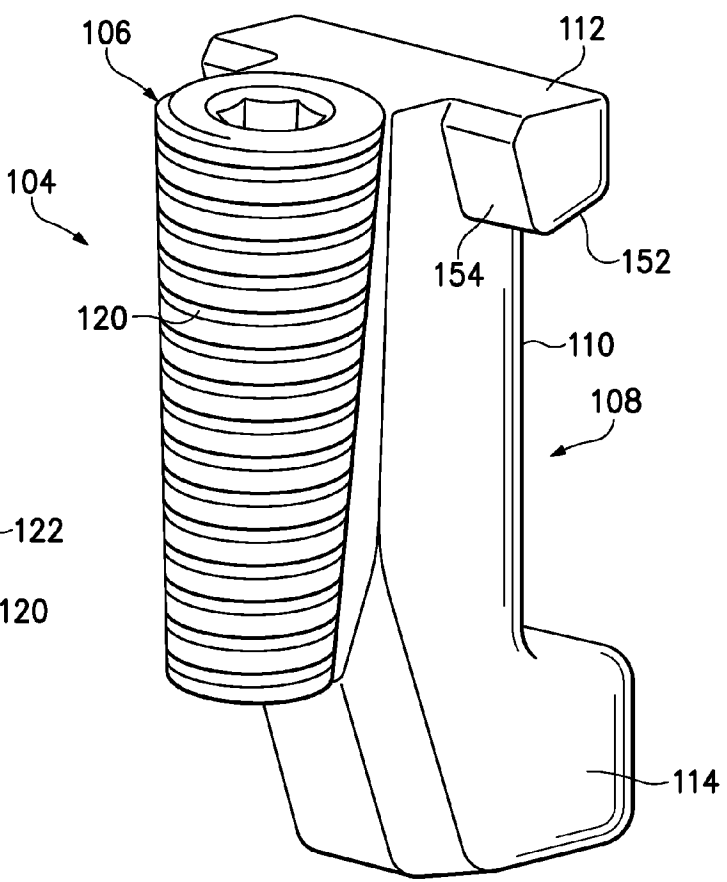
FIG. 9 is a perspective view of a lock assembly in accordance with the present invention.
Figure 8:
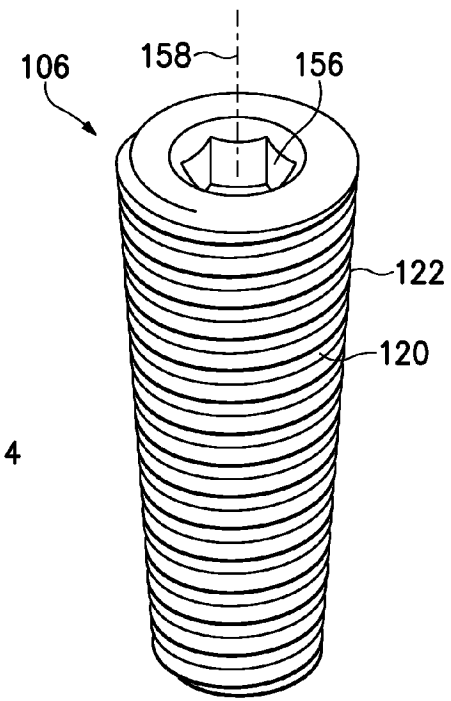
FIG. 8 is a perspective view of a wedge in accordance with the present invention.
Figure 7:
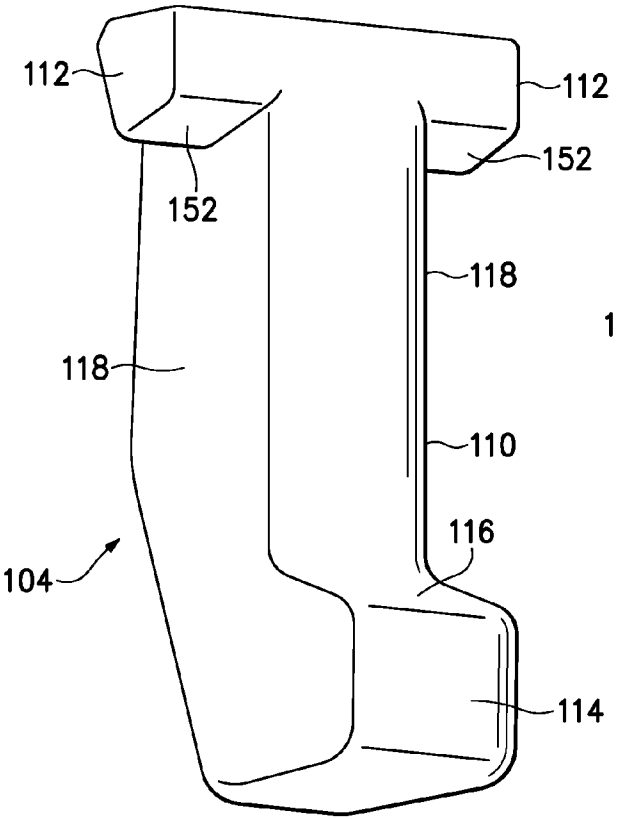
FIG. 7 is a rear perspective view of the spool.

Spool 108 preferably includes a cavity 160 in trough 128 (FIG. 6). A retainer 162 preferably formed of a rubber, foam or other elastomer is fit within the cavity to press outward against the exterior surface 122 of wedge 106. The retainer provides resistance to prevent loosening of the wedge as the bucket is used in digging operations. Of course, other retainers could also be used to prevent loosening.

Figure 12:
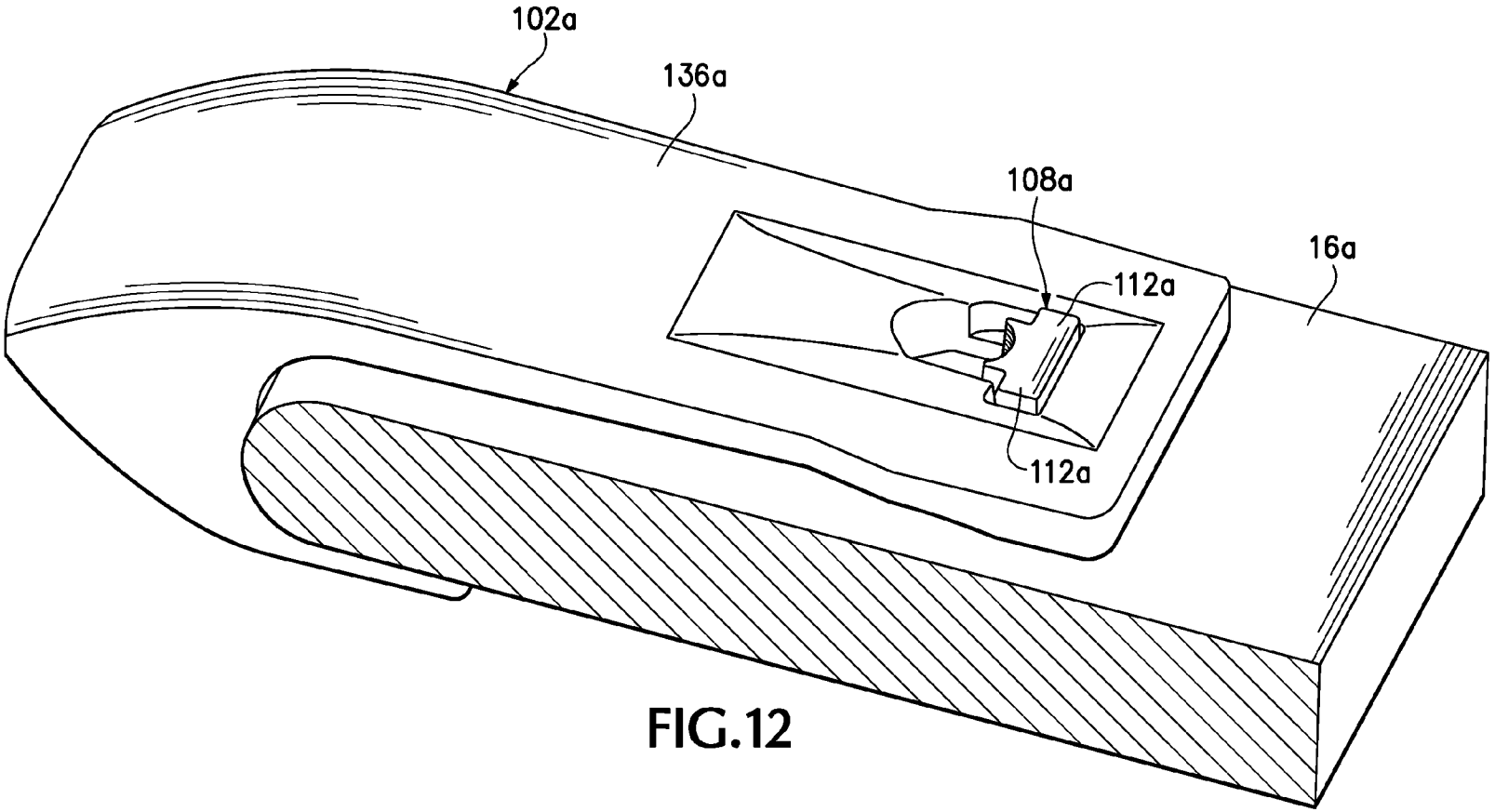
FIG. 12 is an upper perspective view of an alternative wear assembly of the present invention without the wedge.
Figure 13:
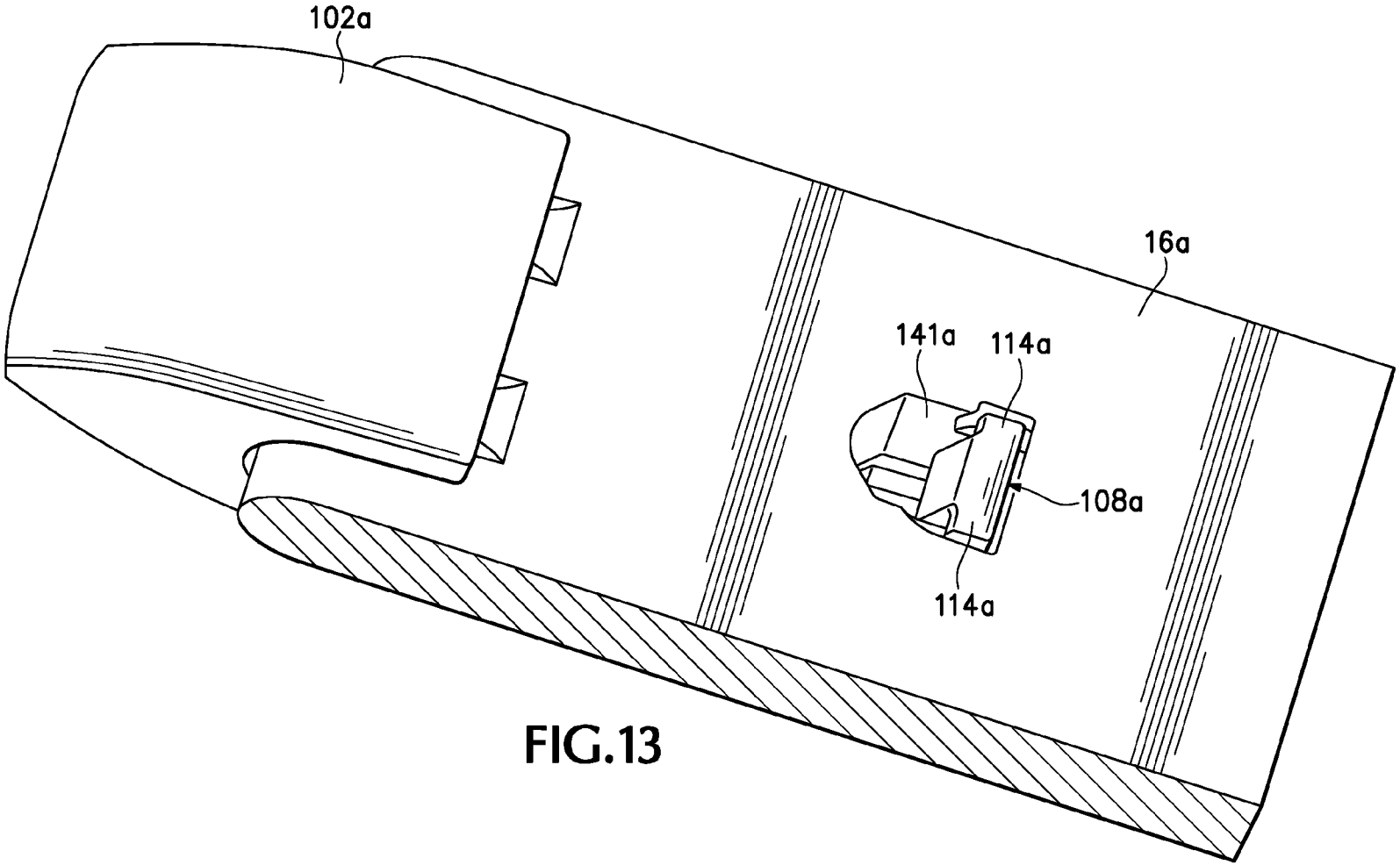
FIG. 13 is a bottom perspective view of the alternative wear assembly without the wedge.
Figure 14:
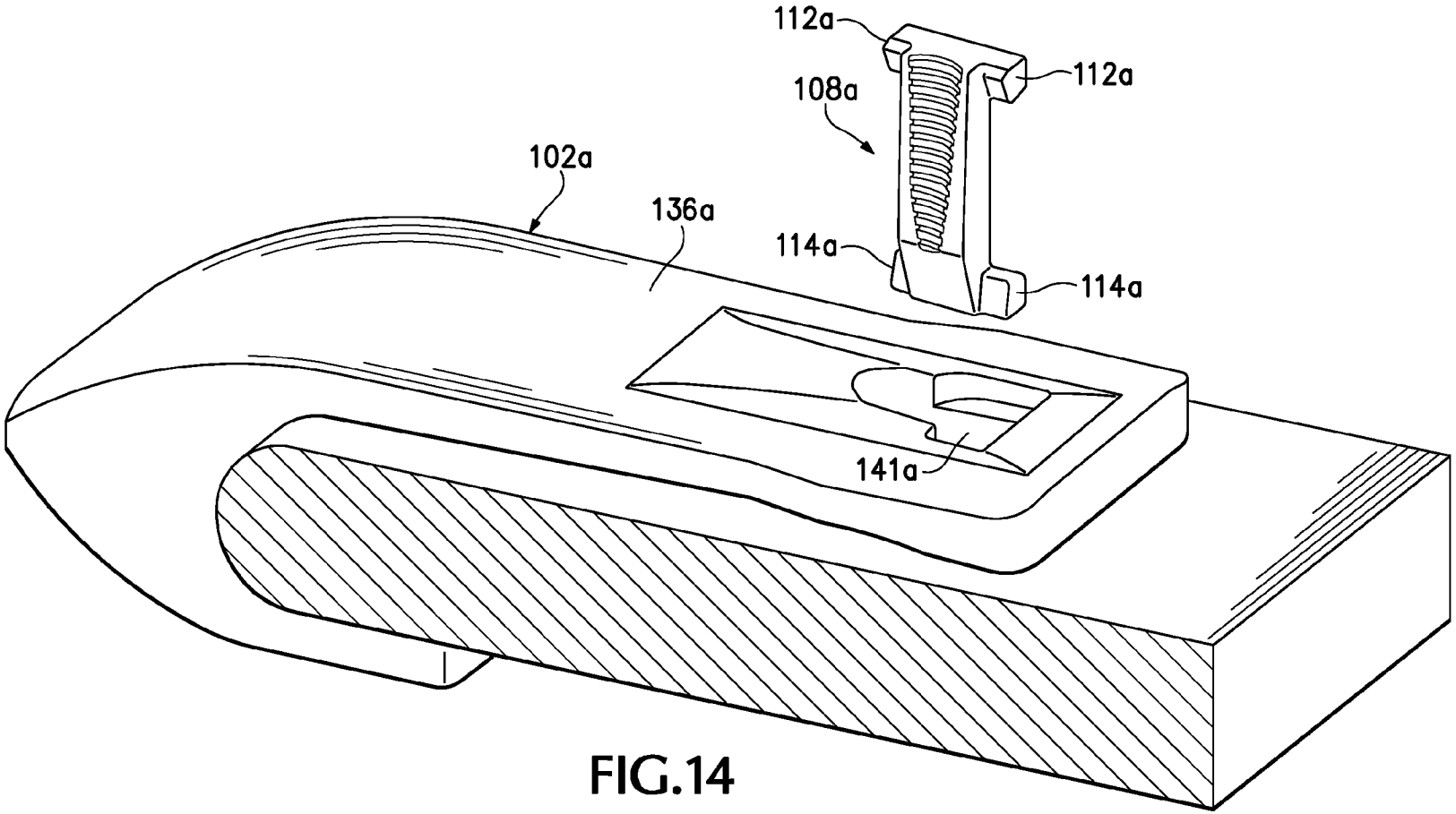
FIG. 14 is an exploded perspective view of the alternative wear assembly without the wedge.
Figure 15:
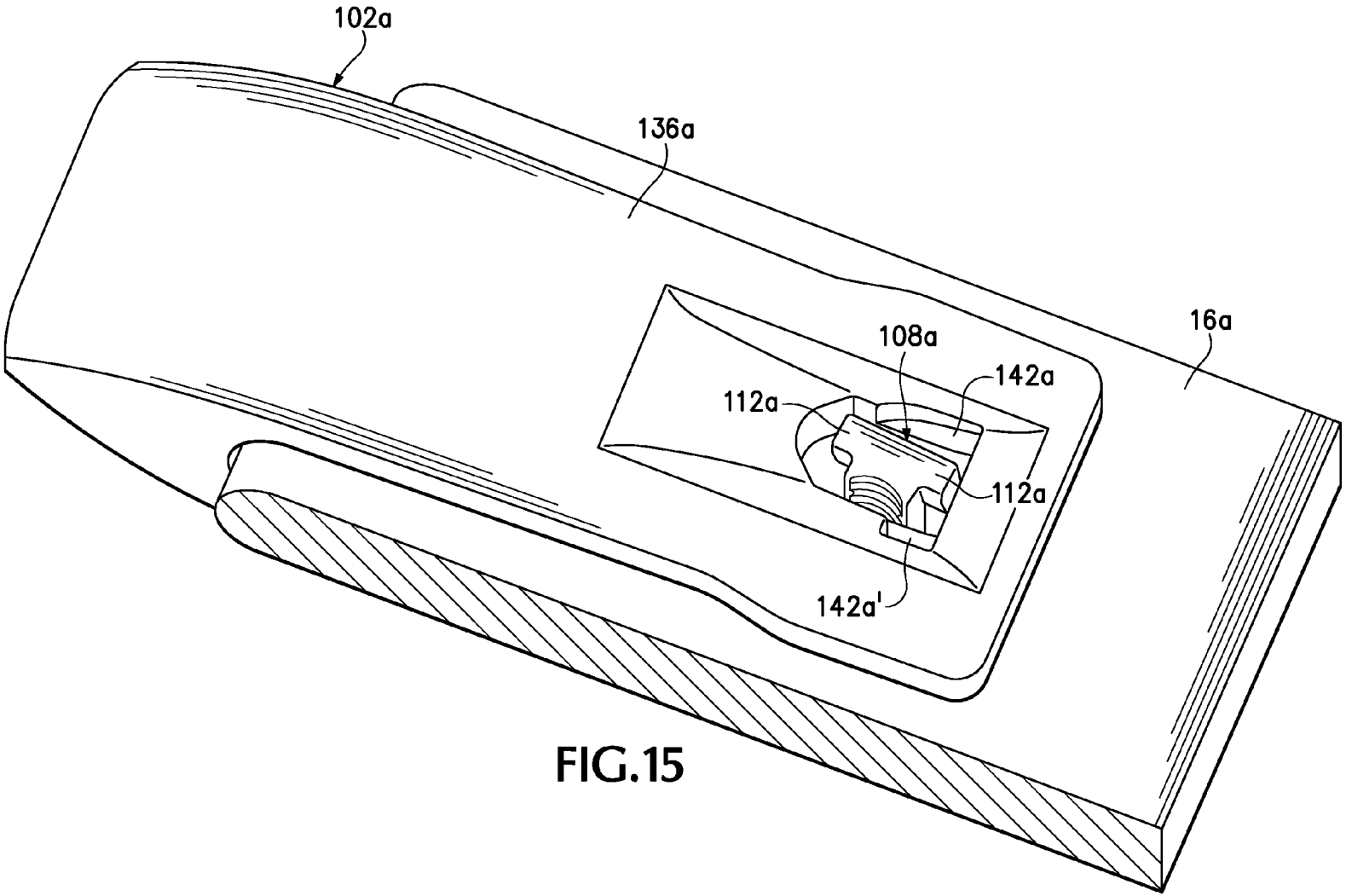
FIG. 15 is a perspective view of the alternative wear assembly with the spool partially installed into the wear assembly.
Figure 16:
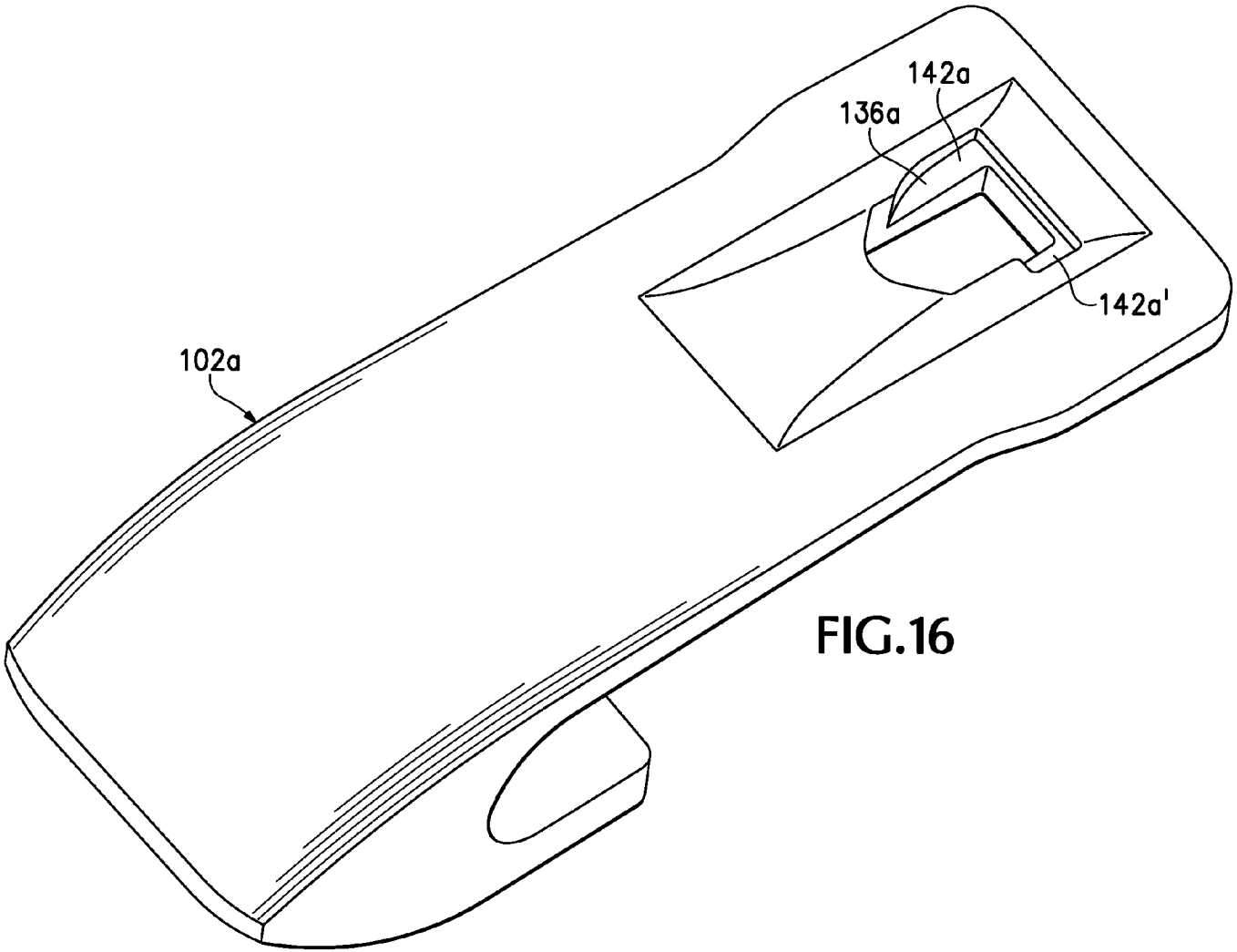
FIG. 16 is a perspective view of the alternative wear member.
Figure 17:
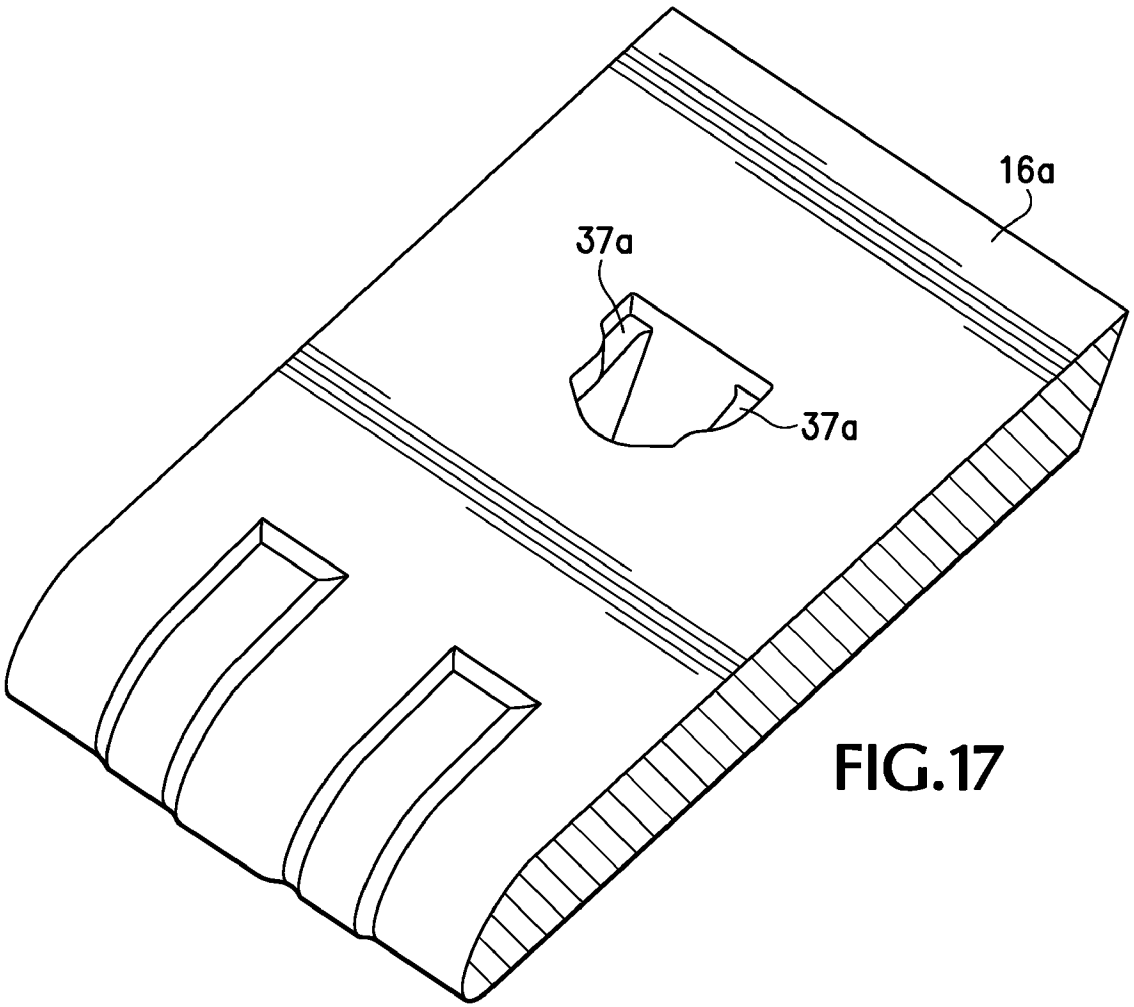
FIG. 17 is a bottom perspective view of a portion of a lip adapted to be used with the alternative wear assembly.
Figure 19:
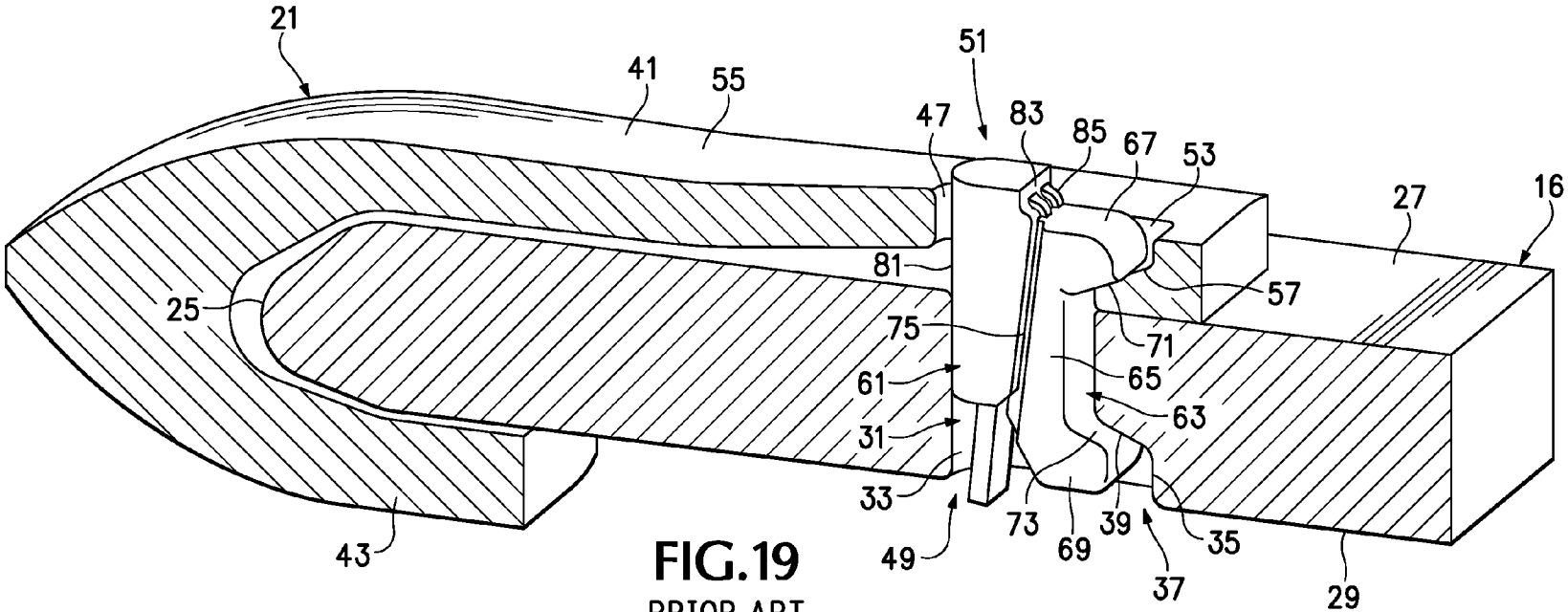
FIG.19 PRIOR ART
FIG. 19 is an axial cross-sectional view of a wear assembly of the prior art.

In an alternative embodiment (FIGS. 12-17), spool 108*a* is formed with lower lateral arms 114*a* as well as upper lateral arms 112*a*. The lip 16*a* is, then, formed with lower spool supports 37*a* (FIG. 17) rather than the conventional axial step 37 (FIG. 19). Upper lateral arms 112*a* can retain the same structure as arms 112. Spool 108*a* is turned ninety degrees for installation into passage 141*a* (FIGS. 14 and 15). Specifically, spool 108*a* is initially turned so that lower lateral arms 114*a* extend generally parallel to the rearward extension of inner leg 136*a* of wear member 102*a*, i.e., forward and rearward relative to passage 141*a*. In this way, the spool can be inserted into passage 141*a* until the lower arms can be set in side steps 37*a*. Side steps 37*a* are formed in the outer surface of lip 16 to have the same construction as side steps 142 described above for shroud 102. Shroud 102*a* is formed with asymmetrical side steps or recesses 142*a*, 142*a*' to accommodate turning of spool 108*a* when placing lower arms 114*a* into side steps 37*a* (FIGS. 12, 14 and 15). Specifically, step 142*a* preferably has a longer axial shape than step 142*a*', and no stop, to accommodate the swinging of the front upper lateral support 112*a* (during installation) into step 142*a*. Step 142*a*' has a bearing surface and stop essentially the same as steps 142.

Other modifications can also be made to the lip, lock or wear member. As examples only, the lower leg of the wear member can be extended and provided with a recess(s) for receiving the lower arm(s) or the spool instead of the lip structure (FIG. 18), such as in U.S. Patent Application Publication No. 2004/0216334, which is incorporated herein by reference. The shapes of the upper and lower spool supports along with the configuration of the bearing surfaces and stops could be altered. A hammered wedge could be used with a spool in accordance with the present invention instead of a rotating wedge. A wedge driven by a separate screw member or composed of multiple parts that apply an expansion force could also be used with a spool utilizing the novel lateral arms. Additionally, various inserts (such as between the front wall of the hole in the lip and the wedge) could be included in the through-holes to improve the locking or wear of the assembly.

The invention claimed is:

1. A wear member for attachment to a lip of an excavating bucket wherein the lip has an inner surface, an outer surface and at least one through-hole extending through the lip, the through-hole opening in each of the inner and outer surfaces and having a shoulder defined between the inner and outer surfaces, the wear member comprising a front end to contact materials to be gathered into the bucket during excavating, an inner leg to extend along the inner surface of the lip, the inner leg including an inner surface to set against the inner surface of the lip, an opposite outer surface, and a hole extending through the inner leg that generally aligns with the through-hole in the lip when the wear member is placed on the lip to receive a lock to hold the wear member to the lip, an outer leg to extend along the outer surface of the lip, the outer leg being shorter than the inner leg and ending forward of the through-hole, a recess in the inner leg to each lateral side of the hole, each recess opening in the hole and in the outer surface of the inner leg to receive laterally projecting arms of the lock, and a bearing surface in each recess to contact the respective arm of the lock so that the wear member is held to the lip.

2. A wear member in accordance with claim 1 wherein each of the bearing surfaces is inclined away from the lip in a rearward direction.

3. A wear member in accordance with claim 2 wherein each of the bearing surfaces is inclined in the rearward direction at a uniform slope.

4. A wear member in accordance with claim 1 wherein a gap is defined between the inner and outer legs to receive the lip, and the gap is open laterally to accommodate the lateral extension of the lip beyond the wear member.

* * * * *